US012383085B2

(12) United States Patent
Carr et al.

(10) Patent No.: US 12,383,085 B2
(45) Date of Patent: Aug. 12, 2025

(54) BUOYANT FREEZABLE INSULATED DRINK HOLDER

(71) Applicant: BACARUBA, LLC, Chicago, IL (US)

(72) Inventors: Alexander Carr, Chicago, IL (US); Robert Pisani, Jr., Wallingford, CT (US); Earl Winslow, Sayre, PA (US)

(73) Assignee: Bacaruba, LLC., Chicago, IL (US)

( * ) Notice: Subject to any disclaimer, the term of this patent is extended or adjusted under 35 U.S.C. 154(b) by 24 days.

(21) Appl. No.: 18/048,507

(22) Filed: Oct. 21, 2022

(65) Prior Publication Data

US 2023/0165394 A1 Jun. 1, 2023

Related U.S. Application Data

(60) Provisional application No. 63/262,894, filed on Oct. 22, 2021.

(51) Int. Cl.
*A47G 23/02* (2006.01)
*B65D 81/38* (2006.01)
(Continued)

(52) U.S. Cl.
CPC ..... *A47G 23/0216* (2013.01); *B65D 81/3883* (2013.01); *F25D 3/06* (2013.01);
(Continued)

(58) Field of Classification Search
CPC ..... A47G 23/0216; A47G 23/04; A47G 2023/0275; A47G 2023/0843; F25D 31/006; F25D 31/002; F25D 3/06; F25D 2303/0843; F25D 2303/0845; B65D 81/3883; B65D 81/3886
(Continued)

(56) References Cited

U.S. PATENT DOCUMENTS 3,766,975 A 10/1973 Todd
4,571,194 A 2/1986 Kiss et al.
(Continued)

FOREIGN PATENT DOCUMENTS

CN 111954447 A 11/2020

OTHER PUBLICATIONS

Floatie Personal Floating Cooler, [online], [retrieved on Oct. 7, 2021]. Retrieved from the internet <URL: https://coolfloat.com/product/floaty/>.
(Continued)

*Primary Examiner* — Rafael A Ortiz
(74) *Attorney, Agent, or Firm* — Bishop & Diehl, Ltd.

(57) ABSTRACT

A floating beverage holder designed to chill and maintain a cold beverage container in an upright position on water. The beverage holder includes an open cavity sized and shaped to accommodate a desired beverage container, or multiple beverage containers. A first sealed compartment substantially surrounds the cavity and includes a freezable material, such as water, refrigerant or a gel. A second compartment filled with a buoyant and insulative material, such as a polyurethane, substantially surrounds the first compartment. A hard outer shell protects the insulative material of the second compartment. The body of the holder is shaped to provide stability on the water surface.

15 Claims, 6 Drawing Sheets

(51) Int. Cl.
*F25D 3/06* (2006.01)
*F25D 31/00* (2006.01)

(52) U.S. Cl.
CPC .... *F25D 31/006* (2013.01); *A47G 2023/0283* (2013.01); *F25D 2303/0831* (2013.01); *F25D 2303/0843* (2013.01); *F25D 2303/0845* (2013.01)

(58) Field of Classification Search
USPC ..... 220/560
See application file for complete search history.

(56) References Cited

U.S. PATENT DOCUMENTS 4,638,645 A 1/1987 Simila
5,067,328 A 11/1991 Medina et al.
5,088,948 A 2/1992 Scheurer
5,361,604 A * 11/1994 Pier ..... B65D 81/3883 62/530
5,727,709 A 3/1998 Nobile
6,085,926 A * 7/2000 Weiss ..... B63B 22/24 220/560
7,195,132 B1 * 3/2007 Balam ..... A47G 23/02 383/3
7,784,759 B2 8/2010 Farrell
8,756,856 B1 * 6/2014 Girvin ..... A01K 97/20 220/560
8,770,434 B2 7/2014 Shearer
9,555,949 B1 * 1/2017 French ..... F25D 3/08
11,141,012 B1 10/2021 Roffey
2004/0040968 A1 * 3/2004 Visser ..... G09F 23/02 220/560
2004/0200232 A1 * 10/2004 Gano, III ..... B65D 81/3816 62/457.2
2005/0133510 A1 * 6/2005 Lake ..... A47G 23/0216 220/560
2006/0043250 A1 3/2006 Farrell
2008/0078788 A1 4/2008 Degges et al.
2010/0252560 A1 * 10/2010 Churchill ..... B63B 35/00 220/592.2
2012/0175373 A1 * 7/2012 Emerson, III ..... B63B 22/24 220/560
2013/0280973 A1 * 10/2013 Elder ..... F16L 1/24 441/133
2015/0096324 A1 4/2015 Marchiori
2016/0022072 A1 1/2016 McDowell
2018/0215525 A1 * 8/2018 Vogel ..... F25D 3/125
2020/0275792 A1 9/2020 McCutchen
2023/0089498 A1 * 3/2023 Hamilton ..... B63B 34/565 441/129

OTHER PUBLICATIONS

CM Neoprene Floating Drink Holder Floating Coaster Pool Drink Holder for Pool Party Water Fun, [online], [retrieved on Oct. 7, 2021]. Retrieved from the internet <URL: https://www.amazon.com/CM-Neoprene-Floating-Holder-Coaster/dp/B08DNSS9MC?th=1>.

* cited by examiner

BUOYANT FREEZABLE INSULATED DRINK HOLDER

RELATED APPLICATION

The current disclosure claims the filing priority of U.S. Provisional Application No. 63/262,894, titled "Buoyant Freezable Insulated Drink Holder," and filed on Oct. 22, 2021. The '894 application is hereby incorporated by reference.

TECHNICAL FIELD OF THE INVENTION

The present disclosure relates to floating drink holders. More specifically, the disclosure is directed to a reusable, insulated drink holder which is able to actively cool a beverage positioned within the holder while it floats.

BACKGROUND OF THE INVENTION

Cup holders are generally cylindrical devices or compartments designed to circumscribe a beverage container to maintain the container in an upright position at a given location. Cup holders may include various attachments to secure the holder to a larger object, such as a car, bike, chair, etc. A typical cup holder has a cylindrical body made from plastic, or in some cases metal.

A development in these beverage holders came when the cylindrical body provided an insulative quality. That is, the typical cylindrical body could include an insulative material, such as an extruded polystyrene (e.g., Styrofoam®) or a polyurethane. These holders were able to keep cold drinks cool and hot drinks warm for a reasonable period of time, depending on the ambient temperature and other conditions.

Inflatable cup holders came about to allow a user to float a beverage container on the water for use at the pool or beach. However, these devices are often either not properly weighted or not properly designed to remain upright when holding a beverage container, especially if the water is moving or turbulent—as it often is.

At present, no known beverage holders have been developed which are able to keep a cold beverage cold for long periods and float upright regardless of the water conditions. Accordingly, a holder is needed which can solve these problems in the art.

Until the invention of the present application, these and other problems in the prior art went either unnoticed or unsolved by those skilled in the art. The present invention provides a floating beverage holder which performs multiple functions without sacrificing portability features, design, style or affordability.

SUMMARY OF INVENTION

There is disclosed herein an improved insulated floating beverage holder which avoids the disadvantages of prior devices while affording additional structural and operating advantages.

A novelty floating beverage holder is designed to maintain a beverage container in an upright position through turbulent or moving water. The beverage holder includes an open cavity which is sized and shaped to preferably accommodate a single desired beverage container but may be capable of holding multiple beverage containers in specific embodiments. A first sealed compartment substantially surrounds the cavity and is comprised of a freezable material, such as a refrigerant or gel. A second compartment substantially surrounds the first compartment and is comprised of a buoyant and insulative material, such as polyurethane or similar polymer or foam material. A hard outer shell protects the insulative material of the second compartment.

The beverage holder is sufficiently buoyant to float the holder and an added beverage container, including its contents. The beverage holder may also include a ballast to keep the beverage holder oriented upright in the water. The outer surface of the beverage holder may be shaped such that it is symmetrical about all vertical axis passing through a midpoint. However, the beverage holder is preferably shaped and weighted to be wider and heavier on a lower portion of the holder.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
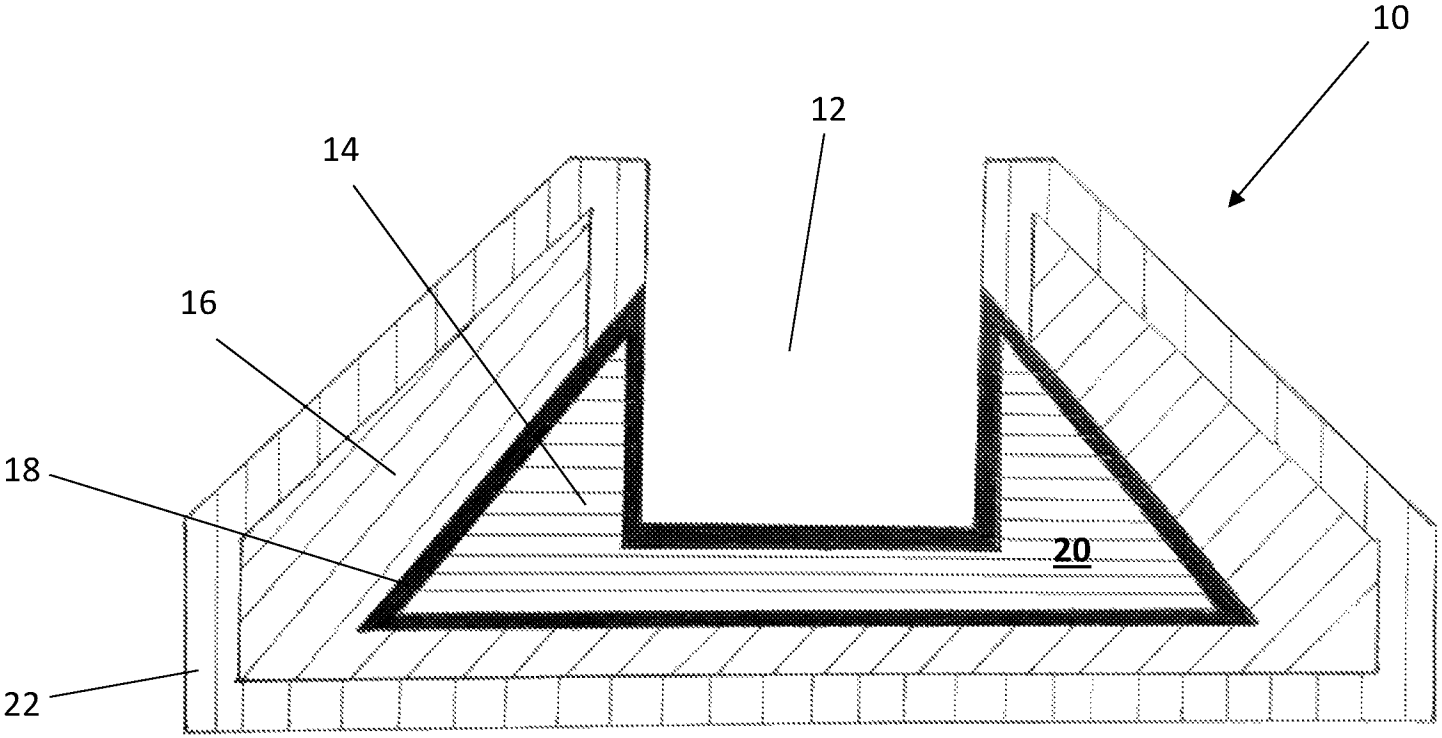
FIG. 1 is a cross section of an embodiment of the disclosed floating beverage holder.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-6, there is illustrated at least one preferred embodiment of an insulated beverage holder, generally designated by the numeral 10. The particular illustrated beverage holder 10 is for a cylindrical drink container, such as a cup, can, or bottle. However, while all the embodiments illustrated are directed to a cylindrical cavity, it should be understood that the principles of the invention can be more broadly applied to any shape or size drink container, such as a handled mug, water glass, drink carton, disposable plastic cup, pitcher, large drink bottle, carafe and the like.

As can be seen in FIG. 1, the holder 10 is comprised of an open cavity 12 defined by a first compartment 14 which is enveloped in a second compartment 16. In the illustrated embodiment, the first compartment 14 includes a thin insulative wall 18 made of, for example, aluminum or an aluminum alloy. Alternative thermally conductive materials, including alloys and polymers, may be used. Within the sealed first compartment 14 is a freezable material 20 such as, for example, a liquid (e.g., water or refrigerant) or gel (i.e., non-Newtonian fluids), which freezes at a desirable low temperature—i.e., preferably between −25° to 32° F. The material is considered "freezable" in that it can be cooled to a low temperature and will absorb a significant amount of heat before reaching ambient temperature. That is, the freezable material should have a substantially high latent heat of fusion, preferably greater than 50 J/g. Most preferably, the latent heat of fusion of the freezable material is greater than 100 J/g.

There should be a high degree of surface contact between the cylindrical cavity 12 and the first compartment 14, as this contact helps cool and maintain the temperature of any container placed within the open cavity 12.

The second compartment 16 is used to insulate the first compartment 14 against ambient conditions, as well as provide buoyancy properties to the holder 10. For this reason, the second compartment 16 is shaped and weighted to provide maximum stability to the holder 10. A polyurethane material is preferred for filling the second compartment 16, though other insulative, buoyant materials may be suitable. Such suitable insulative materials may include foams, recycled plastics and rubbers, cellulosic material, and even air or other gas. A layer of hard plastic, such as a HDPE, is used to contain and protect the softer polyurethane.

Figure 2:
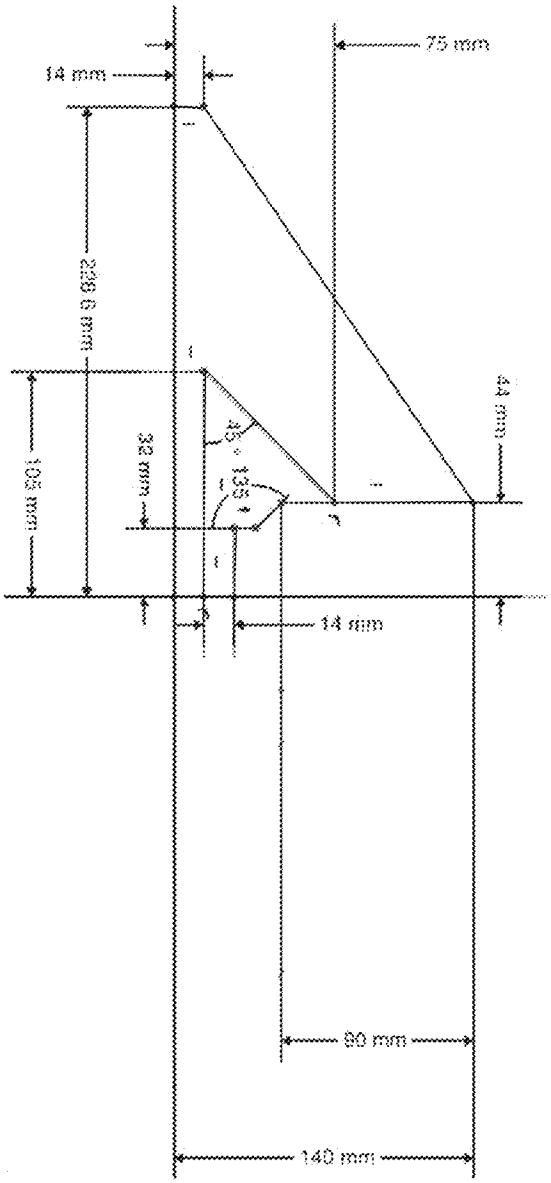
FIG. 2 is a schematic showing measurement details of an embodiment of the disclosed floating beverage holder.
Figure 3:
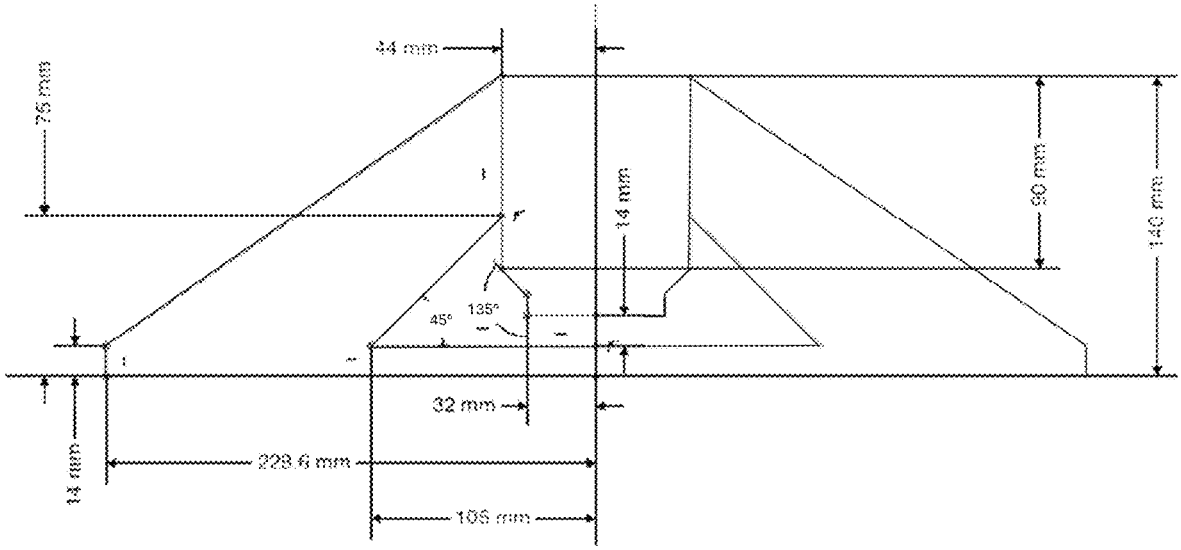
FIG. 3 is another schematic showing measurement details of an embodiment of the disclosed floating beverage holder.

Referring to FIGS. 2 and 3, dimensions for one embodiment of a standard-sized drink holder 10 are shown. In specific embodiments, the disclosed holder 10 is designed to hold a standard twelve (12) fluid ounce can or sixteen (16) fluid ounce bottle of liquid (not shown) within the open cavity 12. Naturally, the holder 10 may be configured to accommodate many different sized and shaped beverage containers, as previously mentioned. In an alternate embodiment, the walls of cavity 18 may be billowed, and soft sided to allow conforming to a container shape when inserted. Such a configuration could allow one size cavity to conform to several different sized and shaped containers.

Figure 4:
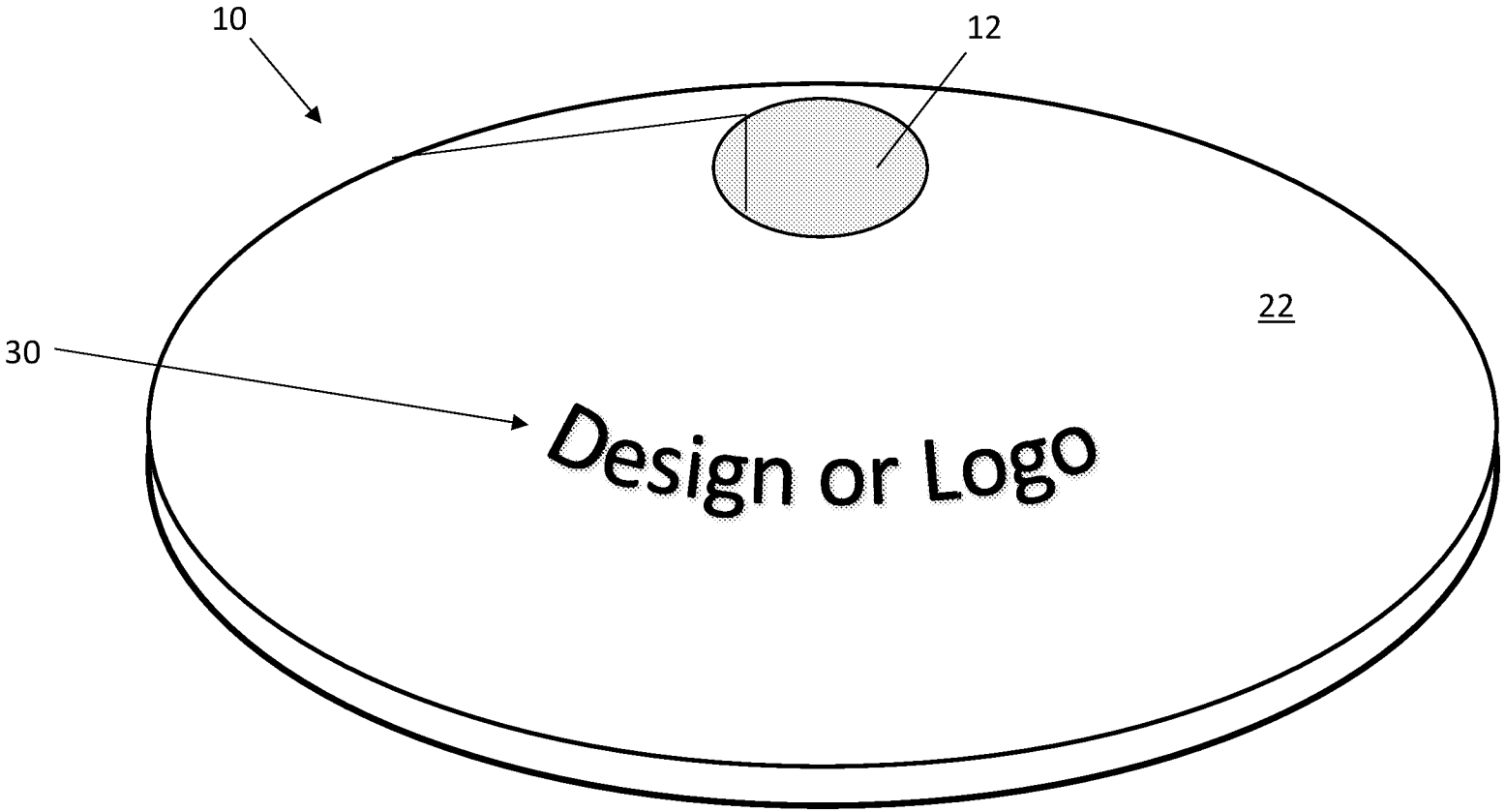
FIG. 4 is a top perspective view of an embodiment of the disclosed floating beverage holder.
Figure 5:
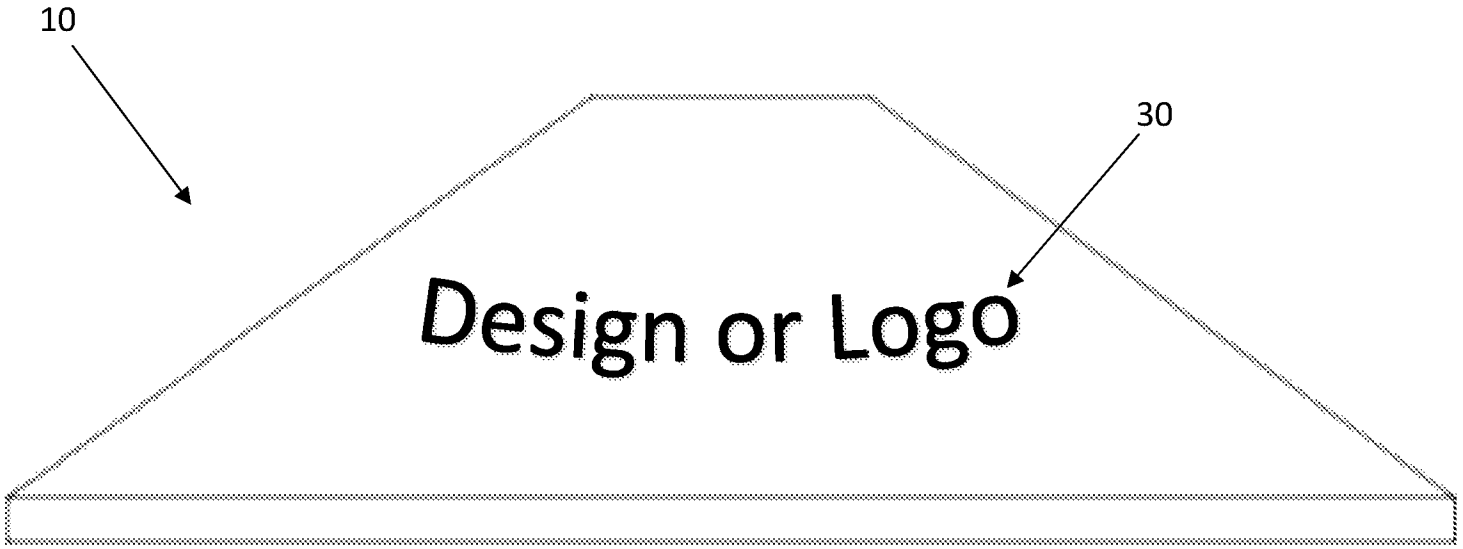
FIG. 5 is a side view of the embodiment of FIG. 4.

FIGS. 4 and 5 illustrate a preferred embodiment of the disclosed drink holder 10. The top outer surface 22 is preferably sloped to prevent pooling of water, which may affect the buoyancy. Additionally, as illustrated, the outer surface 22 of the holder 10 may be customized with, for example, a design/logo 30 such as a favorite sports team logo and colors, corporate names, family names, holiday designs, or the like.

In use, the cup holder 10 can be stored before and after use in a standard freezer or refrigerator. The freezable material 20 of the first compartment 14 will freeze or at least reach a sufficiently cold temperature such that the open cavity 12 will become cold and a container placed within the open cavity 12 will be kept cold for a substantial period of time.

Figure 6:
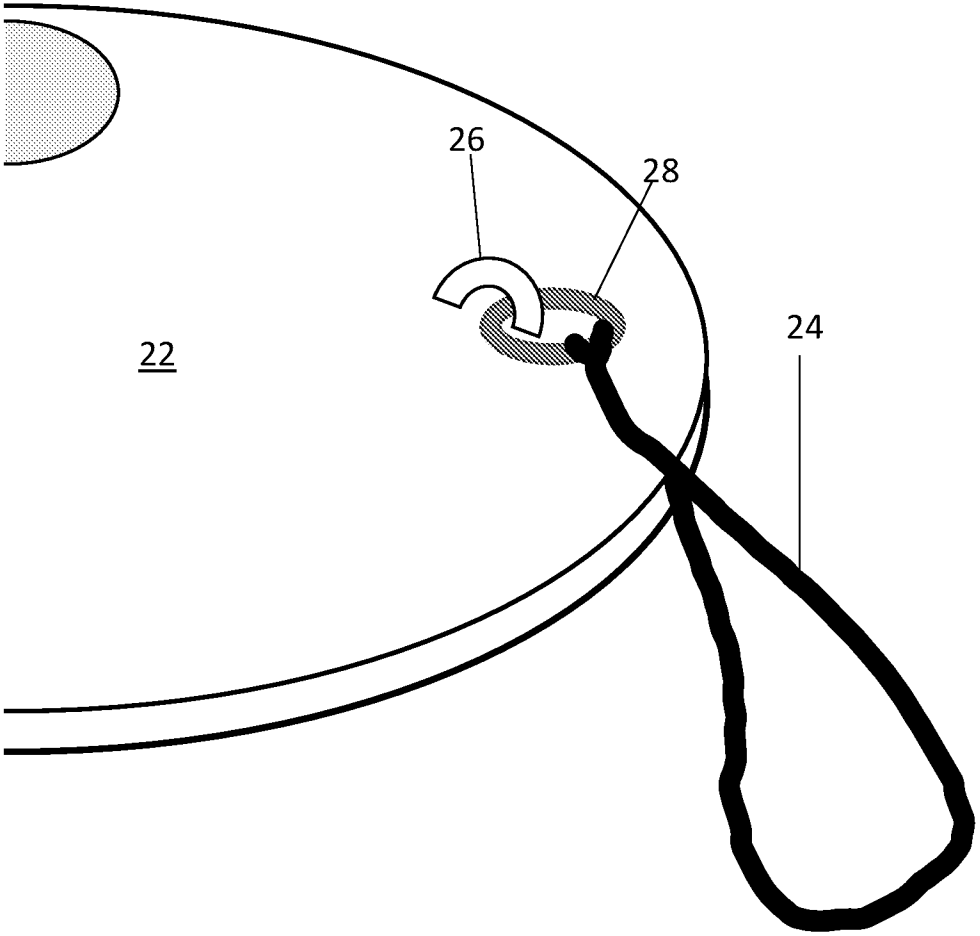
FIG. 6 is a partial side view of an embodiment of the disclosed floating beverage holder with an attached lanyard.

In additional embodiments, a lanyard or tie rope 24 may be attached to an outer surface 22 of the holder 10 to secure to a person, boat, raft, deck, or other floating or fixed structure. As shown in FIG. 6, a D-ring 26 can be adhered to the outer surface 22 (on the top or edge) and the lanyard or tie rope 24 can be quick connected to and disconnected from the D-ring 26 using a clip 28. Obviously, other mechanisms exist which are known to those of skill in the art and could readily be applied for use with the disclosed holder 10.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A drink holder comprising:

a body having a height, a diameter, and an upward facing outer surface radially extending in 360 degrees from a centered open cavity defined by:

a first sealed compartment defining a lower portion of the cavity; and a second sealed compartment enveloping the first sealed compartment and defining an upper portion of the cavity;

wherein, the open cavity is configured for placement of a drink container, the body width is about three times greater than the body height, the first sealed compartment contains a freezable material, and the second sealed compartment contains a buoyant, insulative material.

2. The drink holder of claim 1, wherein the outer surface is comprised of a hard plastic material.

3. The drink holder of claim 1, wherein the freezable material is a liquid.

4. The drink holder of claim 3, wherein the liquid has a latent heat of fusion greater than 50 J/g.

5. The drink holder of claim 4, wherein the liquid has a latent heat of fusion greater than 100 J/g.

6. The drink holder of claim 3, wherein the liquid is water.

7. The drink holder of claim 3, wherein the liquid is a refrigerant.

8. The drink holder of claim 1, wherein the freezable material is a non-Newtonian fluid.

9. The drink holder of claim 1, wherein the freezable material is a gel.

10. The drink holder of claim 9, wherein the gel has a latent heat of fusion greater than 50 J/g.

11. The drink holder of claim 9, wherein the gel has a latent heat of fusion greater than 100 J/g.

12. The drink holder of claim 1, wherein the insulative material is polyurethane.

13. The drink holder of claim 1, wherein the insulative material is selected from one of a polymer, foam, cellulosic material, recycled material, gas, gel, or the like.

14. A drink holder comprising:

a body having a height, a diameter, and an upward facing outer surface radially extending in 360 degrees from a centered open cavity defined by:

a first compartment containing a freezable material having a latent heat of fusion of greater than 50 J/g; and a second compartment comprised of an insulative material and enveloping the first compartment;

wherein, the open cavity is configured for placement of a drink container, and the body width is about three times greater than the body height with the open cavity in an upward facing surface.

15. The drink holder of claim 14, further comprising a connection point on the body and a lead line attached by an end to the connection point.

* * * * *